US011624582B2

(12) United States Patent
Paul

(10) Patent No.: US 11,624,582 B2
(45) Date of Patent: Apr. 11, 2023

(54) TOY WATER GUN ACTUATION MECHANISM

(71) Applicant: Spyra GmbH, Munich (DE)

(72) Inventor: Julia Paul, Munich (DE)

(73) Assignee: Spyra GmbH, Munich (DE)

( * ) Notice: Subject to any disclaimer, the term of this patent is extended or adjusted under 35 U.S.C. 154(b) by 0 days.

(21) Appl. No.: 17/835,658

(22) Filed: Jun. 8, 2022

(65) Prior Publication Data

US 2022/0404118 A1 Dec. 22, 2022

(30) Foreign Application Priority Data

Jun. 18, 2021 (EP) ..... 21180420

(51) Int. Cl.
*F41B 9/00* (2006.01)
*B05B 11/00* (2006.01)

(52) U.S. Cl.
CPC ..... *F41B 9/0071* (2013.01); *B05B 11/3057* (2013.01); *B05B 11/3059* (2013.01); *F41B 9/0018* (2013.01)

(58) Field of Classification Search
CPC .. F41B 9/0071; F41B 9/0018; B05B 11/3057; B05B 11/3059
See application file for complete search history.

(56) References Cited

U.S. PATENT DOCUMENTS 6,364,219 B1 * 4/2002 Zimmerman ..... F41B 9/0012 239/394
6,631,830 B2 10/2003 Ma et al.
2002/0020712 A1 * 2/2002 Hornsby ..... F41B 9/0018 222/113

FOREIGN PATENT DOCUMENTS

KR 20030096630 A 12/2003

OTHER PUBLICATIONS

European Office Action for corresponding European application EP 21 180 420.8, 3 pages, dated Jul. 5, 2022.
Canadian Office Action for corresponding Canadian application 3,159,215, 5 pages, dated Jul. 20, 2022.
International Search Report and Written Opinion for for corresponding International (PCT) application PCT/EP2022/066582, 13 pages, dated Aug. 9, 2022.
Extended European Search Report for corresponding European application EP 21 180 420.8, 5 pages, dated Dec. 2, 2021.

* cited by examiner

*Primary Examiner* — Frederick C Nicolas
(74) *Attorney, Agent, or Firm* — Ruggiero, McAllister & McMahon LLC

(57) ABSTRACT

A toy water gun actuation mechanism for controlling opening of a valve with a base, a trigger, a coupling member being configured to be connected to the valve member and including a movably supported blocking member with an abutment that enables a valve to be opened and closed in a given period if the blocking member is in a blocking position and if the coupling member is in the a first position, the abutment then being positioned in trajectory of the coupling member defined by a movement of the coupling member from the first position into a second. If the blocking member is in its non-blocking position, the abutment is located outside the trajectory. A first elastic member is connected to the trigger and to the coupling member, The trigger has a pusher dog configured to move and/or release a movement of the blocking member into a non-blocking position.

20 Claims, 12 Drawing Sheets

TOY WATER GUN ACTUATION MECHANISM

CROSS REFERENCE TO RELATED APPLICATIONS

This application claims foreign priority to European Patent Application No. EP 21 180 420.8, filed on Jun. 18, 2021, the entirety of which is incorporated herein by reference.

FIELD OF THE RELATED TECHNOLOGY

Described is an actuation mechanism for controlling opening of a valve of a toy water gun. The valve has a valve member with a closed position and an open position. The actuation mechanism can be used for controlling the valve member of a toy water gun. The actuation mechanism comprises a base and a trigger. The trigger is movably supported relative to the base and has an actuated position and a non-actuated position. The actuation mechanism may further comprise a coupling member configured to be connected, e.g., directly or a via a valve member connection rod, to a valve member, wherein the coupling member is movably supported relative to the base between a first position and a second position.

DESCRIPTION OF THE RELATED ART

There are generally two conceptual different types of toy water guns. A first set of toy water guns have a trigger, being coupled to a water pump. Actuating the trigger operates the water pump and the water is sprayed by a water pump through a nozzle. A second set of toy water guns has a water reservoir being pressurized. The pressurized water reservoir is fluidly connected via a valve with the nozzle. The trigger is coupled via an actuation mechanism to the valve and hence actuating the trigger results in opening the valve.

A toy water gun with an actuation mechanism is disclosed in U.S. Pat. No. 6,631,830 B. The toy water gun has a pressurized water reservoir being fluidly connected via a ball valve with a nozzle. The ball valve has a rotatably supported valve ball being coupled to a lever arm. The valve ball and hence the lever arm is bistable in an open and in a closed position. To this end, the lever arm is connected via a spring with a pivotably supported connecting member. Operating the trigger, causes the connecting member to pivot, thereby elongating the spring. Initially, the force exerted by the spring pulls the lever arm into its closed position. Continued pull on the trigger results in a continued pivotal movement of the connecting member until the force exerted by the spring on the lever arm towards its open position is greater than the force towards its closed position. Accordingly, the valve ball abruptly rotates into its open position. Once the trigger is released, a trigger spring forces the trigger back into its non-actuated position and thereby the lever arm as well rotates back into its closed position. The ball valve is closed again.

SUMMARY

The actuation mechanism of a conventional water gun lacks haptic feedback when the valve is actually opened and further duration of a 'shot' depends on the operator of the trigger.

The problem to be solved is to provide an improved actuation mechanism for in particular toy water guns.

Described are implementations of an actuation mechanism for a water gun or any other kind of liquid dispenser having a valve for controlling the liquid flow. These valves mostly have a valve member with an open position and a closed position. In the open position, the valve member may release a valve seat or another kind of valve opening enabling a fluid flow through the valve. In the closed position, the valve member may seal the valve seat or the another kind of valve opening, respectively. In an example, the valve member may be movably supported to thereby enable a movement of the valve member from the closed position into the open position and back into the closed position. The movement can be a translation but may as well be a rotation or a superposition of a rotation and a translation.

The water actuation mechanism comprises a base. The base may be a part of a housing of the actuation mechanism and/or may be attached to a housing of the water gun. Unless explicitly specified, movements of other parts of the actuation mechanism are relative to the base. In other words, the base provides a reference system and may support and/or bear any of the other parts at least indirectly. For example, a trigger of the actuation mechanism may be movably supported relative to the base. The trigger is thus movable at least from a non-actuated position to an actuated position and can be movable back to the non-actuated position. In operation, a user may pull and hence move the trigger from the non-actuated to the actuated position (and optionally even beyond) to thereby open the valve (if the actuation mechanism is connected to a valve). The trigger can thus be considered as a user interface for controlling a water flow from the liquid reservoir through the valve to the nozzle of the water gun. Only for completeness, the valve outlet may be the and/or configured as the nozzle.

As already apparent the non-actuated and the actuated position of the trigger may but are not necessarily end positions. In an example, the non-actuated position and the actuated position are not end positions. For example, the trigger may be movable beyond these positions by for example at least 1%, 2%, 5% and/or 10% of the distance between the non-actuated position and the actuated position.

The actuation mechanism may further comprise a coupling member. The coupling member may be configured to be connected or may alternatively be connected to a valve member and/or to a valve member connection rod and/or unitary with at least one of these. The coupling member may thus be considered as an interface between the trigger and the valve member. The coupling member can comprise a coupling adapter. The coupling adapter may be configured to receive and/or to be attached and/or coupled to a (for example distal) portion of the valve member and/or a (for example distal) portion of a valve member connecting rod. The term distal references to the valve opening, i.e., the distal end faces way from the valve opening, wherein the proximal portion of the valve member is the portion that closes the valve seat, if the valve member is in the closed position.

Similar to the trigger, the coupling member is can be movably supported relative to the base, for example by the base. The coupling member is thus movable at least between a first position and a second position. Herein, we consider the first position as the position of the coupling member in which a valve member, if coupled to the coupling member closes the valve and the second position as the position of the coupling member in which the valve member is in the open position. Alternatively, one may replace the term "first position" by "position of the coupling member in which an optionally coupled valve member is in its closed position" and "second position" by "position of the coupling member in which an optionally coupled valve member is in its open position". The first and second positions are not necessarily end positions of the coupling member. In practice, the coupling member can be moved at least from the first position beyond the second position and/or from the second position beyond the first position. For example, the coupling member can be movable beyond these positions by for example at least 1%, 2%, 5% and/or 10% of the distance between the first and the second position. The movement is not necessarily a translation, but may as well be rotation or a superposition of a translation and a rotation, e.g. a pivotal movement.

The direction of the movement of the coupling member can be at least substantially parallel to the direction of the movement of the trigger. At least substantially parallel includes parallel and also includes deviations by an angle $\alpha$ that can be accepted, in particular if the absolute value of the angle $\alpha$ is smaller or equal than an angle $\alpha_c$, wherein $\alpha_c \in A_c = \{30°, 20°, 10°, 5°, 2.5°, 1°, 0.5°, 0°\}$, which can be expressed by the relation $|\alpha| \leq \alpha_c$.

The actuation mechanism may further comprise a blocking member. The blocking member can be movably supported relative to the base and can be movably supported by the base. Thus, the blocking member may be movably supported enabling a movement of the blocking member at least between a blocking position and a non-blocking position and back to the blocking position. If the blocking member is in the blocking position, the blocking member blocks a movement of the coupling member from the first to the second position. In other words, if the blocking member is in the blocking position and if the coupling member is in the first position, then an abutment of the blocking member may block a movement of the coupling member from the first position into the second position. In the blocking position the abutment can be located in the trajectory being defined by a movement of the coupling member from the first to the second position. Equivalent to blocking the movement by a positive fit of the abutment and the coupling member, the abutment may provide an interference fit.

If the blocking member, however, in its non-blocking position, the abutment is located outside the trajectory being defined by the coupling member, when the coupling member is moved (e.g. shifted, rotated or pivoted) from the first position to the second position. Thus, if the blocking member is in its non-blocking position, the coupling member may pass the abutment or in other words, the movement of the coupling member towards the second position is not blocked by the blocking member. Summarizing, the blocking member in the non-blocking position does not interfere a movement of the coupling member, whereas it does in the blocking position.

In an example, the blocking member has a through hole and/or a recess. A protrusion of the coupling member may extend into and/or through the through hole and/or recess, respectively, wherein the protrusion may have a first section and a second section. The second section may have a larger diameter than the first section. Hence, the surface connecting the peripheral surfaces of the first section and of the second section may abut the boundary encircling the through hole and/or recess. The boundary may thus provide an abutment for the coupling member, if the blocking member is in the blocking position. To move the blocking member in the non-blocking position one may simply align the center of the through hole and/or recess with the center of the second section. A movement of the blocking member into the non-blocking position may comprise shifting the blocking member's boundary encircling the through hole and/or recess in the trajectory of the surface connecting the peripheral surfaces of the first section and of the second section, which then abuts the blocking member if moved from the first to the second position.

A first elastic member, e.g., a spring or any other kind of potential energy storage, may be connected to the trigger and to the coupling member. Thus, moving the trigger relative to the coupling member against the restore force of the first elastic member enables to preload the coupling member towards the trigger. The connection between the trigger and the first elastic member and/or between the coupling member and the first elastic member may be a releasable connection, as will be explained below in more detail. The potential energy being stored by the first elastic member can be increased, if the trigger is moved from its non-actuated (i.e. released) position towards its actuated position while the coupling member is maintained in a given position, for example, in its first position, for example by the blocking member. Thus, the potential energy stored by the elastic member may be minimized (i.e. have a (at least local) minima or an absolute minima) if the trigger is in the non-actuated position while the coupling member is in the first position and/or if the trigger is in the actuated position and the coupling member is in the second position.

In an example, the elastic member is connected to the trigger by position controlled coupling. The position controlled coupling can be configured to enable a movement of the trigger during a predefined portion of the path to the actuated position while not loading the first elastic member and to force transmittingly couple the trigger to the first elastic member once the trigger has been moved the predefined portion of the path. Thus, only when the trigger is moved past this predetermined portion of the path, the first elastic member is loaded. This predetermined portion of the path can be small compared to the full length of the path and may be for example equal or smaller than one of 25%, 20%, 15%, 10% or 5% of the full path, while being bigger or equal than at least one of 1%, 2%, 3%, 4%, 5% of the full path. Once the trigger has been moved the predefined portion, the position controlled coupling force transmittingly connects the trigger to the first elastic member and hence a further movement of the trigger towards the actuated position loads the first elastic member. This measure enables to reliably reposition other components of the actuation mechanism, once the trigger has been released, as the first elastic member is uncoupled prior to the trigger reaching its non-actuated position. In particular moving the optional coupling member into the initial first position can be enhanced as will become apparent below in more detail.

The trigger can be connected to a first end of an elastic member, herein referred to as "trigger elastic member", only to enable a verbal distinction from other elastic members suggested herein. The trigger elastic member can have a lower spring rate than the first elastic member and can be configured to reposition the trigger into the non-actuated position, (if it has been released). The second end of the trigger elastic member may be connected to the base or any other part being static relative to the base. This measure as well enhances the reliability of the actuation mechanism, as the movement of the trigger into the non-actuated position by the trigger elastic member may entrain and/or force the coupling member or other portions of the actuation mechanism into their respective initial position(s) while the first elastic member is unloaded.

The trigger may comprise a pusher dog configured to move the blocking member from the blocking to the non-blocking position, if the trigger is moved from its non-actuated position towards its actuated position. The pusher dog can be unitary with the trigger, but it may as well be a separate part. All being required is that a movement of the pusher dog can be directly coupled to the trigger. From another viewpoint one may say that the trigger may in any case comprise the pusher dog, but that the trigger is not necessarily unitary, hence the pusher dog moves with the trigger.

For example, the pusher dog may push or pull and/or entrain the blocking member towards the non-blocking position, if the trigger is moved towards the actuated position, e.g. if the trigger reaches the actuated position or another predefined position in between of the non-actuated and the actuated position. The pusher dog can engage and/or entrain the blocking member by a positive fit. Alternatively or in addition, the pusher dog may be coupled to the blocking member via an elastic member. Only to distinguish this elastic member verbally from other elastic members we refer to it herein as "release elastic member" as it contributes to releasing the blocking member. If the pusher dog is coupled to the blocking member via the release elastic member, moving the trigger towards the actuated position exerts a force to the blocking member having at least a component pointing towards the unblocking position. This force being transmitted via the release elastic member increases with an increase of travel of the trigger towards the actuated position until the blocking member breaks free and is moved by conversion of the potential energy stored in the release elastic member into its non-blocking position. Hence the blocking member is driven out of the trajectory of the coupling member from the first position to the second position. The coupling member may thus be moved towards its second position.

As usual the pusher dog may be protrusion extending from the trigger and/or a lever and/or a rod or the like being force transmittingly coupled to the trigger. In case the pusher dog is coupled via the release elastic member to the blocking member, the pusher dog may simply be an attachment point for the release elastic member.

The pusher dog may hence drive and/or control the movement of the blocking member and may optionally by this movement preload an elastic member biasing the blocking member into its blocking position. Alternatively and/or in addition, the blocking member may be biased, i.e. preloaded, by another optional elastic member towards its non-blocking position and the pusher dog may release the movement, thereby reducing the preload. All these alternatives serve the same purpose: The blocking member is moved into the non-blocking position when the trigger reaches a predefined position while being moved towards the actuated position. Thereby, when operating the trigger, first the first elastic member is loaded while the coupling member is maintained in a given position (e.g.: the first position) by the blocking member. Thus, the first elastic member exerts a force on the coupling member, wherein the force has at least a component pointing towards the second position of the coupling member, but a movement of the coupling member towards the second position is blocked by the blocking member until the pusher dog of the trigger moves and/or enables a movement of the blocking member into the non-blocking position and thereby initiates a movement of the coupling member into the second position. Hence, an optionally coupled valve member may be moved by a repeatable and predetermined force from the closed position into the open position, regardless whether a user pulls the trigger quickly or slowly. Further, the interaction of the pusher dog with the blocking member can be sensed by the user. The actuation mechanism thus provides a haptic feedback to the user. The suggested solution enables to open the valve particularly quickly, and thereby the impression of a water bullet being released by the water gun can be created, while keeping manufacturing costs low and providing for an enhanced life span and reliability of operation of the actuation mechanism and thus of the water gun.

The actuation mechanism may further comprise a slider. As the name implies, the slider can be movably supported relative to the base, e.g. by a plain bearing. Other types of movable support can be used as well, and the term slider shall not be construed as limiting. The term slider could be replaced by the term "another movable member". Only to increase legibility and to render the description more vivid the term slider is used instead of the term another movable member and this usage shall be considered only as an example for the another movable member. Thus, the term slider can be generalized by the term another movable member.

The slider may be movable relative to the base at least from a third position to a fourth position and back to the third position. The terms third position and fourth position have been selected only to clearly distinguish from the first and second positions the coupling member may be moved to. Thus, the term third position may be considered as and hence replaced by "the first position of the slider" and the fourth position may be considered as and hence replaced by "the second position of the slider". The trajectory of a movement of the slider from the third position to the fourth position is at least substantially parallel to the trajectory of a movement of the trigger from the non-actuated to the actuated position. Similarly, the trajectory of a movement of the slider from the third position to the fourth position can be (as well or alternatively) at least substantially parallel to the trajectory the coupling member when being moved from the first position to the second position.

The slider can be releasably coupled to the trigger, e.g., by a controllable coupling. The term controllable coupling implies that the coupling may be opened by a control interface and subsequently be closed again. For example, a locking member may be movably supported by the trigger and/or the slider and/or the base and may have a locking position. In the locking position the locking member may engage into the trigger and the slider, whereas when in the non-locking position the locking member may engage into none of these or at max into one of these, thereby releasing, i.e. unlocking, the releasable coupling, e.g. by opening the controllable coupling. Other forms of releasable couplings may be used as well. In an example the locking member is movable at least substantially orthogonal to the direction of movement of the trigger and/or the slider. The locking member can be or comprise for example a pin and/or bolt or/a trunnion to name only a few examples.

In case the slider is coupled to the trigger, it may connect the trigger with the first elastic member. In other words, the first elastic member may be attached to the slider and thereby the first elastic member may be releasably coupled to the trigger. In case the slider is not coupled to the trigger, the trigger and the first elastic member may be disconnected. In this case, no force is transmitted from the trigger via the first elastic member to the coupling member when the connection is released. The slider may thus enable to move the coupling member from its second position into its first position independently from any movement of the trigger and from any force being required to load the first elastic member, as the slider may as the name almost implies simply follow the coupling member if the releasable coupling is opened. Thus, repositioning of the coupling member to the first position can be initiated independently from and movement or actuation of the trigger. The period the coupling member requires for moving from the first position into the second position (thereby opening the valve, if a valve member is attached to the coupling member) and for moving back into the first position (thereby closing the valve, if a valve member is attached to the coupling member) can be independent from an interaction of a user with the trigger. Only the time when the period starts is controlled by actuating the trigger.

In an example, the trigger and/or the slider may movably support a locking member having a locking position and a non-locking position. The locking member, if in its locking position, may provide a positive locking and/or an interference fit between the trigger and the slider, thereby coupling the slider to the trigger. Accordingly, in case the locking member is in the locking position the slider follows the trigger, which may result in preloading the first elastic member. For example, if the coupling member is in its first position, the blocking member is in its blocking position, and if the trigger is moved from its non-actuated position towards its actuated position. Once the blocking member is moved into the non-blocking position, the coupling member is moved by the force of the first elastic member into the second position. This movement of the coupling member towards the second position may be controlled by the trigger, e.g. once the trigger reaches a predefined position. Subsequently, the locking member may be moved in its non-locking position (for example if the coupling member reached the second position) and thereby release the positive locking and/or the interference fit, respectively. Moving the locking member into the non-locking position opens the releasable coupling and hence uncouples the trigger and the slider. Thus, as already explained before, in this case the coupling member may be moved back into the first position while the position of the trigger or a movement of the trigger does not affect the movement of the coupling member. The closing procedure of the valve can thus be decoupled from the way the trigger is manipulated. In other words, the way the user actuates or releases the trigger does not affect the duration of opening or closing the valve. This improvement enables to provide for clearly distinguishable water drops being released by the water gun. This further enhances the impression of water "bullets".

The locking member, if in its locking position, can be in the trajectory of the coupling member when moving the coupling member from the first position to the second position. Accordingly, the coupling member abuts the locking member, if the locking member is in its locking position and if the coupling member moves towards the second position. The coupling member can be configured to move the locking member into the non-locking position when moving the coupling member from an intermediate position to the second position. Accordingly, when the coupling member abuts the locking member, the coupling member may drive and/or entrain the locking member into the non-locking position and/or release a corresponding movement. Thereby, the slider and hence the coupling member may be decoupled from the trigger, once the coupling member moved a given path (and/or a given angle) towards the second position. This decoupling may reliably control the moment when closing of the valve is initiated independently from any additional action of the user. Closing of the valve can be reliably repeated once a predefined valve opening has been reached. These measures provide for very shorts bursts of water, which not only further increases the impression of firing water bullets, but as well increases the number of "bullets" that can be shot with a given amount of liquid in the reservoir. The costs for providing the capability of ejecting a given number of water bullets is thus decreased.

For example, the locking member may be biased towards its locking position, e.g., by another elastic member. Driving the locking member towards the non-locking position may increase the biasing force. The coupling member may drive the locking member into the un-locking position when being shifted towards its second position, thereby releasing the coupling between the slider and the trigger.

Alternatively, the locking member may be biased towards its non-locking position, in this case the locking position is not in the trajectory of the coupling member, but the non-locking position. Thus, when moving the coupling member from the first position to the second position, the locking member may be released when moving the coupling member towards the second position. The coupling member is so to speak moved out of the trajectory of the locking member, in case the coupling member is moved towards the second position, thereby releasing a movement of the locking member into its non-locking position.

The slider, when in the fourth position may be biased towards the third position. Thus, when decoupling the slider from the trigger if the coupling member at least almost reached its second position, the slider may drive, e.g. entrain, the coupling member into the first position. Again, reliability and reproducibility of closing the valve is further enhanced. This biasing may be due to a second elastic member being loaded if the slider is moved towards the fourth position. In this example, the term second elastic member is only a pars pro toto for any other kind of a second potential energy storage. Alternatively or in addition to loading the second elastic member, the slider may decrease the volume of a pressure reservoir when being moved towards the fourth position. Alternatively or in addition, the coupling member may be returned from the second position into the first position by a force being exerted onto the valve member. In particular in this case, the slider may be releasably coupled to the coupling member. Wherein the releasable coupling is opened after the slider has been moved into the third position and closed when the slider is in the fourth position and the coupling member is (at the same time) in the second position.

At least a portion of the coupling member may be in the trajectory of the slider, when moving the slider from the fourth position to the third position and if the coupling member has not been shifted back into its first position. In this case the slider simply pushes the coupling member towards is first position if the slider is driven by the biasing force toward the third position.

In addition or as an alternative, at least a portion of the slider may be located in the trajectory of the coupling member, when moving the coupling member from the second position to the first position and if the slider has not been shifted back into the third position. In this case the coupling member may be driven by a biasing force towards the first position and entrains the slider (once decoupled).

Assuming the blocking member is in its non-blocking position and the coupling member in the first position, then at least a portion of the blocking member may be in the trajectory of the trigger when moving the trigger towards the non-actuated position. Further, the trigger may be configured to entrain the blocking member into the blocking-position when moving the trigger into the non-actuated position, while the coupling member is in the first position. Thereby the coupling member can be safely and reliably secured in the first position, until the first elastic member is loaded (again) by moving the trigger into the actuated position.

As already apparent, the actuation mechanism may be a part of or integrated into a toy water gun or any other liquid dispensing device. The toy water gun and/or the other liquid dispensing device may further comprise a housing and/or a liquid tank having an outlet and/or a valve with a valve conduit, a valve inlet port, a valve opening, a valve outlet port and a movably supported valve member, wherein the valve member has a closed position in which the valve member closes the valve opening and an open position in which the valve member releases the valve opening. Further, the toy water gun or more generally the liquid dispensing device may further comprise a tube with a tube wall providing a fluid communication of the outlet of the liquid tank with the inlet port of the valve conduit and/or a nozzle being in fluid communication with the outlet port of the valve. The term "tube" may be considered as a synonym to "conduit" and include without being limited to as well "fluid line", "pipe", "hose" or the like. The valve member can be attached to the coupling member, wherein the coupling member is configured to entrain the valve member from the closed position into the open position if the coupling member is moved from the first position into the second position.

The water gun (as an example for any liquid dispensing device) may further comprise a rod having a proximal end and a distal end. The distal end may be attached to and/or unitary with the valve member. The distal end may be attached to and/or be unitary with the coupling member.

The rod can extend through an opening in the tube wall, the valve conduit and/or the liquid tank. This measure enables to locate the entire actuation in the dry portion (=not submerged=not filled with water) of the liquid dispenser, resulting in a shorter valve opening times as well as reduced manufacturing costs.

For example, the liquid tank may be a pressure tank, configured to contain a pressurized liquid and/or the base may integrated into, unitary with and/or attached to a water gun housing or any other kind of liquid dispensing apparatus.

Only for conceptual simplicity we do not distinguish herein between water guns and water pistols. Use of one term shall encompass the other. Further, as already apparent, the toy water guns are only an example for any liquid dispensing device having a valve with a valve member to control dispensing the liquid.

In the foregoing we assumed that a movement of a part implies a change of its position or location relative to other parts like, e.g. the base. In a strict verbal sense this means that the movement is a translation or a superposition of a translation and a rotation. Both alternatives are implementations. In case the movement is a rotation, there may be cases in which the position remains unaltered, only the orientation changes. Herein we did not distinguish between these cases to enhance legibility. Except if the movement is explicitly a pure translation or a pure rotation the terms "position" and "location" can be replaced by "position and/or orientation" and "location and/or orientation", respectively. Further, as explained herein, some trajectories are at least substantially parallel. In a strict mathematical sense, this implies that the trajectories are straight lines, which is an example. In another example, the trajectories can be circles or sections of circular lines. In this another example, circular trajectories shall be considered parallel, if the circular trajectories are at least substantially concentric. At least substantially concentric includes concentric, but also that deviations can be accepted. For example if the absolute value of the distance between the two centers of the two circular lines is smaller than at least one of 1%, 5% 10%, 15% and/or 20% of the maximum radius of the circular lines this shall be considered to be at least approximately concentric.

DESCRIPTION OF DRAWINGS

In the following, embodiments will be described by way of example, without limitation, with reference to the drawings.

DETAILED DESCRIPTION OF THE EMBODIMENTS

Figure 1:
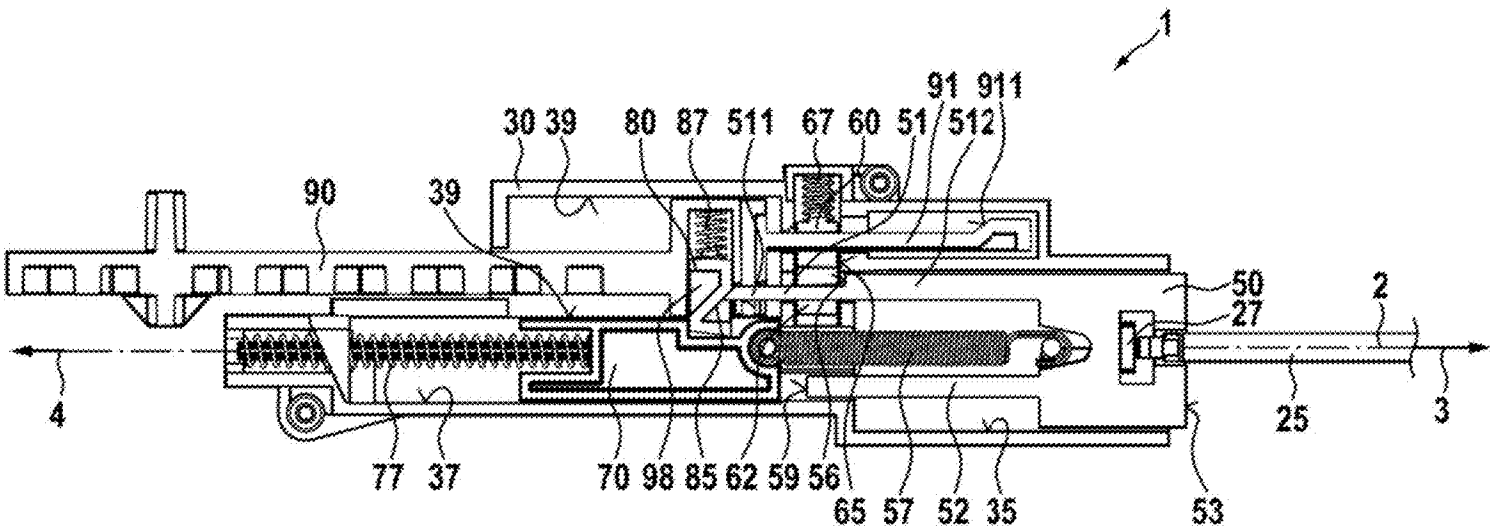
FIG. 1 shows an actuation mechanism in an initial state.

An actuation mechanism 1 in FIG. 1 has a base 30 forming a housing. In FIG. 1 to FIG. 11 an optional over for closing the base 30 has been omitted to visualize the different positions of the parts and their interaction.

As shown in FIG. 1, the actuation mechanism 1 has a coupling member 50 being configured to be coupled to a valve member, e.g. to (or via) a valve rod 25 having a longitudinal axis 2. The coupling member 50 provides an interface which may be adapted to any valve. As shown, the coupling member 50 may for example have an optional recess for receiving the distal end of the valve rod 25 in what is referred to herein as the front side 53 of the coupling member 50. The arrow 3 thus indicates the forward direction 3 and the arrow 4 the rearward direction 4.

The valve rod may be firmly attached to the coupling member, but as well with a predefined mount of axial play, which eases assembly the final liquid dispensing device and further contributes to its reliability and hence quality. For example, as shown in FIG. 1 to FIG. 11, the distal end of the valve rod 25 may extend through an opening into a chamber of the coupling member 50. A lock nut, a retaining ring and/or any other type of axial fastening means 27 may abut the valve sided portion of the chamber wall and thereby entrain the valve member and/or the valve rod 25 in case the coupling member 50 is moved towards the second position, i.e. in the rearward direction 4 (see e.g. FIG. 3). When moving the coupling member 50 towards its initial first position, the distal end face of the valve member and/or of the valve rod 25 may abut the valve facing portion of the chamber wall and thereby entrain the valve and/or the valve rod 25 (see e.g. FIG. 9).

Figure 4:
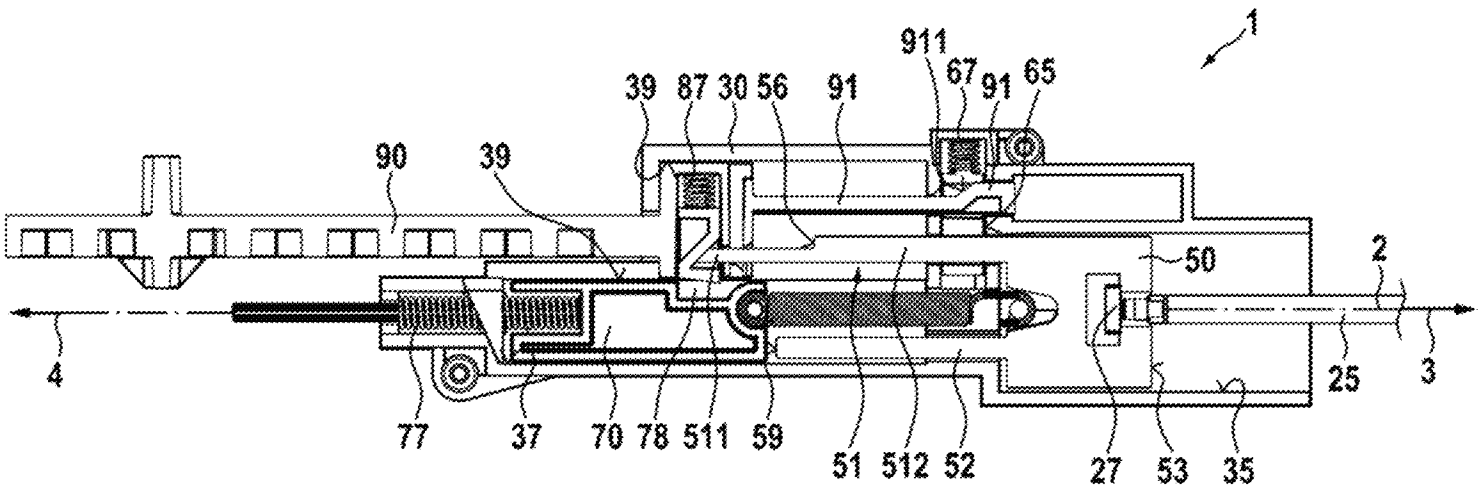
FIG. 4 shows the actuation mechanism in a third state of operation.
Figure 5:
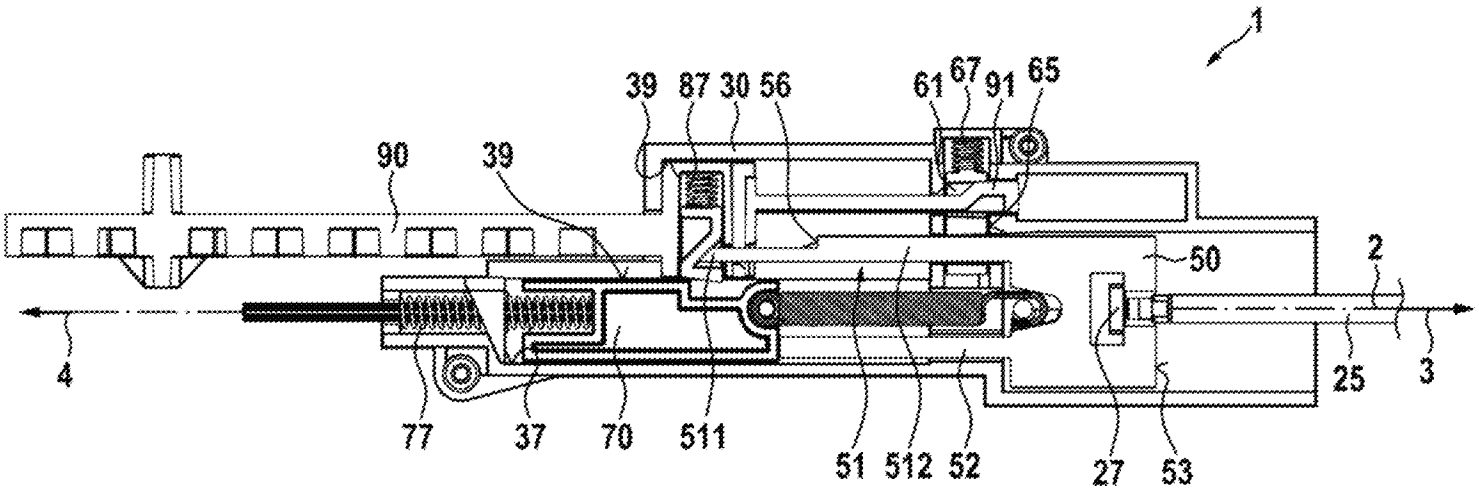
FIG. 5 shows the actuation mechanism in a fourth state of operation.

The coupling member 50 may be movably supported by the base 30. The base 30 thus provides a support structure and one could as refer to the base 30 as support 30 or housing bottom 30. The at least two opposed plain bearing surfaces 35 can extend at least substantially parallel to the forward direction 3 thereby enabling a movement of the coupling member 50 in between of a first position (being shown in FIG. 1) and a second position as shown in FIG. 4.

The actuation mechanism may further comprise a trigger 90. The trigger 90 provides a user interface to open the valve for a duration being defined by the actuation mechanism 1. To this end, the trigger 90 is movably supported by the base 30 and can be moved from a non-actuated position (FIG. 1) into an actuated position (see FIG. 3). Like the coupling member 50, the trigger 90 may as well be movably supported by at least two opposed plain bearing surfaces 39 of the base 30. The trigger 90 may be biased towards the non-actuated position, e.g. by a return spring (omitted in the figures) or any other elastic member and/or potential energy storage.

As can be seen in FIG. 1, a first elastic member 57 (hereinafter first spring 57, to render it more vivid) may couple the coupling element 50 with the trigger 90, for example via a slider 70, being releasably coupled to the trigger 90. The optional slider 70 may as well be movably supported relative to the base 30, for example by plain bearing surfaces 37 being formed like the plain bearing surfaces 35 and 39 by opposing wall structures of the base 30.

Figure 3:
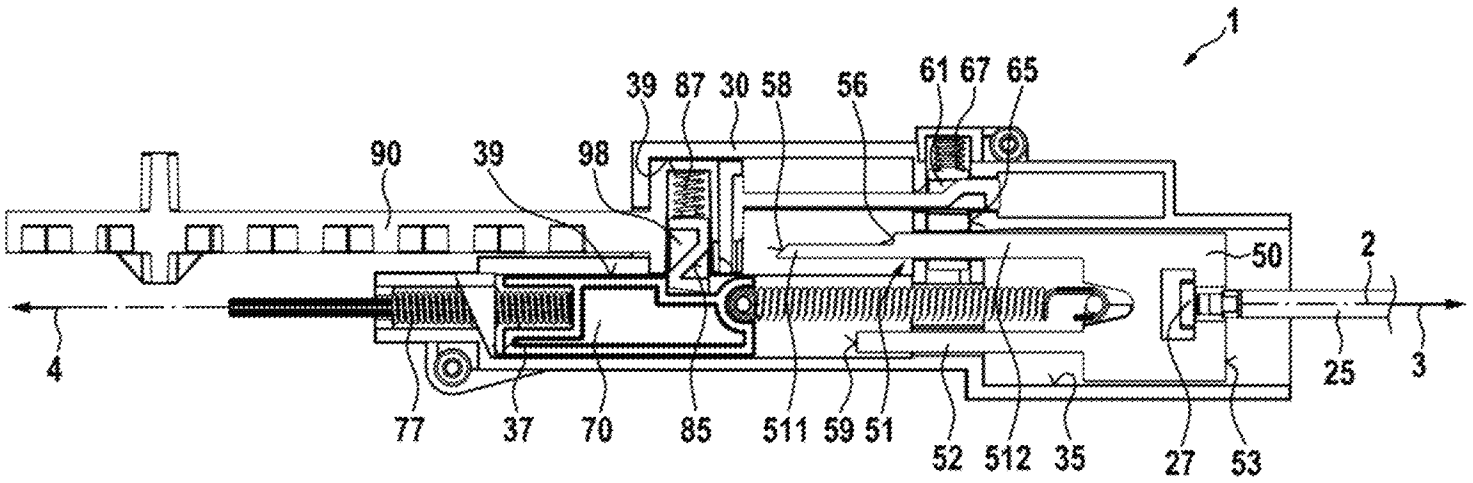
FIG. 3 shows the actuation mechanism in a second stage of operation.

The actuation mechanism 1 may further comprise an optional blocking member 60, having a blocking position (FIG. 1) and a non-blocking position (FIG. 3). The blocking member 60 can be biased by an elastic member 67 (and/or any other kind of potential energy storage) towards the blocking position. The direction of movement of the blocking member 60 is not parallel to the direction of movement of the coupling member 50. In an example, the optional blocking member 60 is movably supported by the base 30, e.g., by plain bearing surfaces enabling a movement of the blocking member 60 at least substantially orthogonal to the movement of the optional coupling member 50 and/or of the optional trigger 90 and/or of the optional slider 70. Again at least substantially orthogonal includes orthogonal, and also includes deviations that can be accepted. For example, deviations from the orthogonal direction by an angle $\alpha_o$ can be accepted, in particular if the absolute value of the angle $\alpha_o$ is smaller or equal than an angle $\alpha_c$, wherein $\alpha_c \in A=\{30°, 20°, 10°, 5°, 2.5°, 1°, 0.5°, 0°\}$, which can be expressed by the relation $|\alpha_o|\alpha_c$.

In FIG. 1 the blocking member 60 is shown in the blocking position. An abutment 56 of the coupling member 50 abuts blocking member 60, or in more detail an abutment 65 of the blocking member 60, thereby preventing the coupling member 50 to follow the trigger 90, towards its actuated position—until the blocking member 60 is moved into its non-blocking position being shown in FIG. 3.

As can be seen in FIG. 1, the blocking member 60 may have an optional first recess 61 and/or an optional second recess 62. An optional first protrusion 51 of the coupling member 50 may extend through the optional second recess 62 of the blocking member 60. A step in the first protrusion 51 may provide the abutment 56 of the coupling member 50. In other words, the protrusion 51 may have at least two sections, a first section 511 with a reduced diameter and a second section 512 with an increased diameter, wherein the step 56 may separate the first section 511 and the second section 512. The second section 512 may be closer to the center of gravity of the coupling member 50 and the first section is farther from the coupling member 50 than the second section 512.

Figure 2:
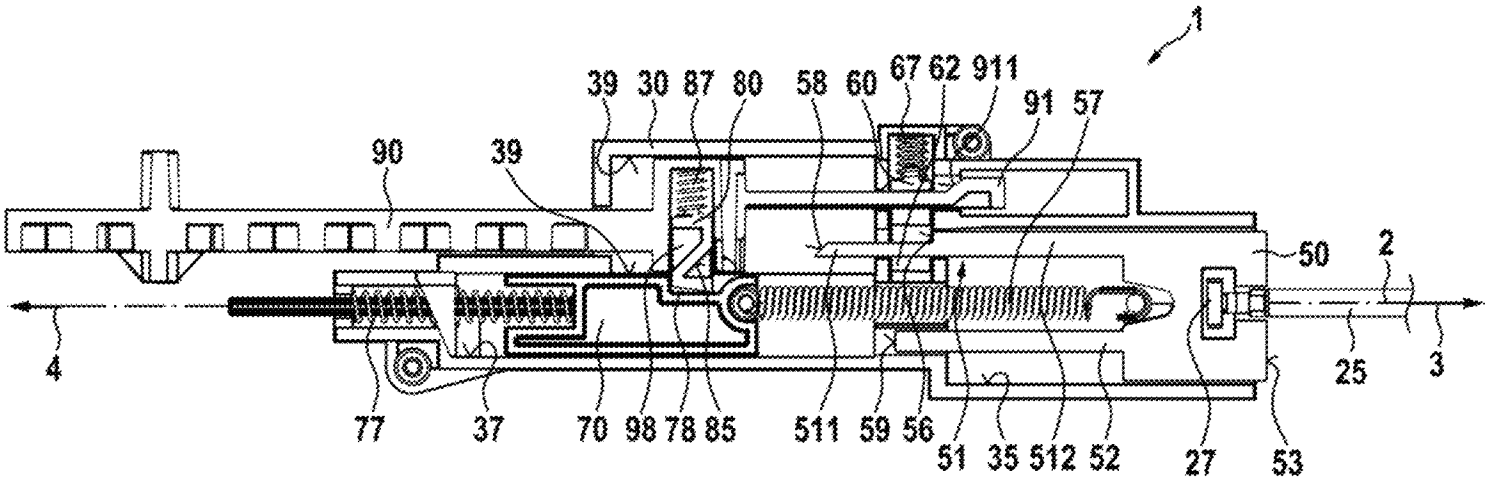
FIG. 2 shows the actuation mechanism in first stage of operation.

As can be seen e.g. in FIG. 1 (cf as well FIGS. 2 to 11), he blocking member 60 may further comprise the first recess 61 through which a protrusion 91 of the trigger extends. The protrusion 91 is as well referred to as pusher dog 91 and may have a surface being inclined relative to a movement of the trigger towards its actuated position and/or relative to the boundary of the first recess 61. Thus, when moving the trigger 90 from the position in FIG. 1 towards its actuated position as shown in FIG. 2, the inclined surface 911 is moved towards the boundary of the first recess 61. The length of the pusher dog 91 can be dimensioned such that the inclined surface 911 reaches the boundary of the first recess 61 if or shortly before the trigger 90 reaches its actuated position, as shown in FIG. 3. Shortly before may be understood for example, the trigger travelled at least one of 50%, 75%, 80%, 85%, 90% or 95% of the path from the non-actuated position of the trigger 90 to the actuated position of the trigger 90 when the inclined surface 911 contacts the blocking member 60. Moving the trigger 90 further thus shifts the blocking member 60 into the non-blocking position, as shown in FIG. 3. Only to avoid misunderstandings, it is noted that FIG. 2 shows the trigger at an intermediate position when being moved towards the actuated position.

Going back to FIG. 1, it can be seen, that the slider 70 may be releasably coupled to the trigger 90: For example, the trigger 90 may movably support a locking member 80 in a recess 98 of the trigger 90. The recess 98 can disable a movement of the locking member 80 in the direction of the movement of the trigger, but allows the locking member 80 to be moved at least substantially orthogonal to the trigger 90 and/or the slider 70. An optional elastic member 87 may bias the locking member 80 into a recess 78 (see FIG. 4) of the slider 70, thereby coupling the slider 70 to the trigger 90 as shown e.g. in FIGS. 1 to 3. Thus, if the locking member 80 is in the locking position, the slider 70 follows a movement of the trigger 90 towards the actuated position of the trigger 90. The locking member 80 may comprise an optional abutment 85 can be inclined relative to the direction of movement of the locking member 80. This optional abutment 85 may be located in the trajectory of coupling member 50, when moving the coupling member 50 from the first position (as shown in FIG. 2) to the second position (as shown in FIG. 4). The distance of the abutment 85 of the locking member 80 spaced from the portion 58 of the coupling member 50 can be configured to abut the abutment 85 of the locking member 80 by at least one of 50%, 75%, 80%, 85%, 90% or 95% of the distance between the portion 58 in the first position and the portion in the second position. Thus, when the portion 58 of the coupling member 50 configured to abut the abutment 85 almost reaches its second position, it abuts the abutment 85 and further moving the coupling member 50 into the second position moves the locking member 80 into the unlocking position (see FIG. 4).

At this point it is noted that it does not matter if the locking member 80 is movably supported by the trigger 90 or the slider 70 or the base 30. For example, similar to the depicted example, the slider 70 may have a recess movably supporting the locking member 80 and the trigger 90 may have a recess into which the locking member 80 may movably engage, to thereby couple the slider 70 and the trigger 90. In other words, the coupling works as well, if the locking member 80 is movably supported by the slider 70 and/or the base 30. In all cases the coupling member 50 may by an abutment 85, be enabled to move the locking member 80 into the non-locking position in which the locking member 80 decouples the trigger 90 and the slider 70.

Operation of the actuation mechanism 1 will be explained in the following by going through the sequence of FIG. 1 to FIG. 11.

FIG. 1 shows the starting positions of the optional coupling member 50, the optional slider 70, the trigger 90, the optional blocking member 60 and of the optional locking member 80, i.e. the trigger 90 is in its non-actuated position, the coupling member 50 is in the first position and the slider 70 is in the third position. The blocking member 60 is in the blocking position and the locking member 80 is in the locking position. Thus, the blocking member 60 inhibits a movement of the coupling member 50 towards the second position and the slider 70 is coupled to the trigger 90. All elastic members 57, 67, 77, 87 may e.g. be relaxed, at least the stored potential energy may have a local minimum in the operation cycle. A certain pretension of bias is allowed, but each potential energy stored by a respective elastic member has a minimum.

In order to open the valve, i.e. to move the coupling member 50 towards the second position a user may move the trigger 90 towards the actuated position (see arrow 4). As can be seen in FIG. 2, in which the trigger 90 is still being moved, the trigger 90 entrains the slider 70 due to the closed releasable coupling as provided by the locking member 80. The potential energy being stored by the first elastic member 57 and by the optional second elastic member 77 are each increased due to moving the trigger 90. The optional pusher dog 91 still moves relative to the optional blocking member 60, without interacting with the blocking member 60.

As soon as the pusher dog's inclined surface 911 abuts the blocking member 60, the user continues moving the trigger 90 into the actuated position and the blocking member 60 is moved into the non-blocking position as shown in FIG. 3. In other words, the pusher dog 91 releases the coupling member 50, and the coupling member 50 is accelerated by the first elastic member 57 towards the slider 70 and/or the trigger 90, entraining the valve member (see FIG. 3). The valve thus starts to be opened, very swiftly, due to the preload of the first elastic member 57.

When the coupling member 50 reaches its second position, the portion 58 of the coupling member 50 configured to abut the abutment 85 of the locking member 80 thereby shifting the locking member 80 into the un-locking position. The coupling between the slider 70 and the trigger 90 is released. It is noted that the time when the coupling is released does not depend on an any user interaction or input-once the blocking member 60 has been moved into the non-blocking position by pulling the trigger 90 into the actuated position.

Once the coupling is released, the slider 70 is driven by the second elastic member 77 from the fourth position (see FIG. 4) towards the third position, thereby abutting and hence entraining the coupling member 50, which results in closing the valve again. In this example the coupling member 50 has an optional abutment surface 59. The optional abutment surface 59 may be located at the slider 70 facing side of an optional second protrusion 52 of the coupling member 50. Relevant is only that the optional abutment surface 59 is in a trajectory of the slider 70 when the slider 70 is moved from the fourth position to the third position.

Figure 6:
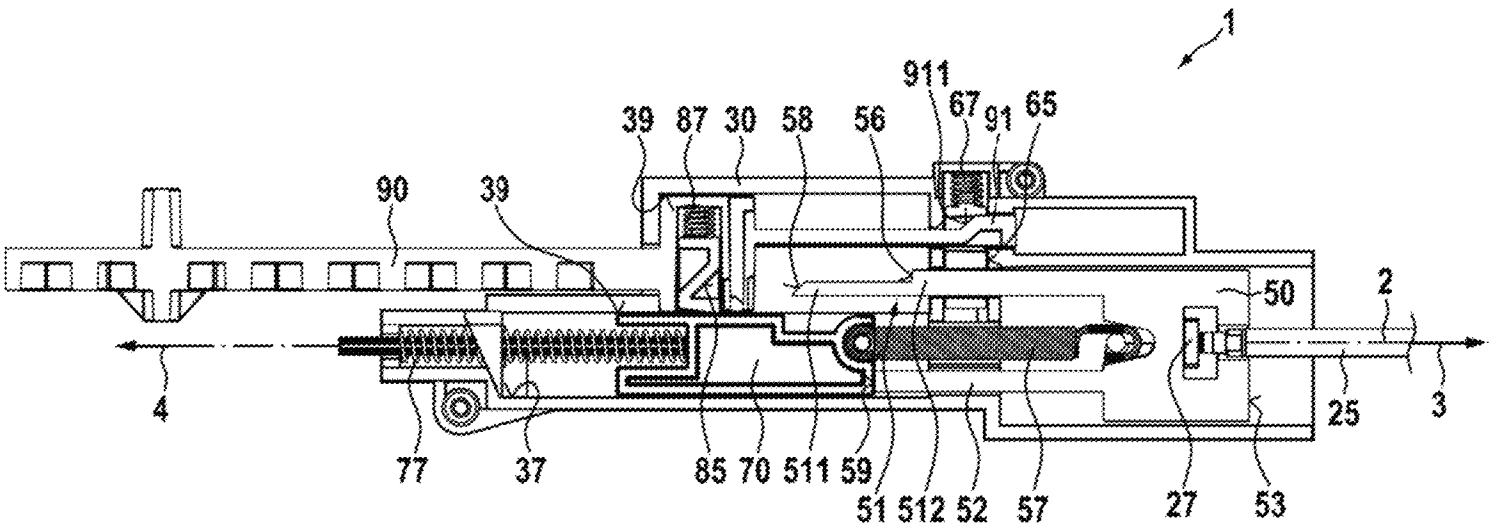
FIG. 6 shows the actuation mechanism in a sixth state of operation.
Figure 7:
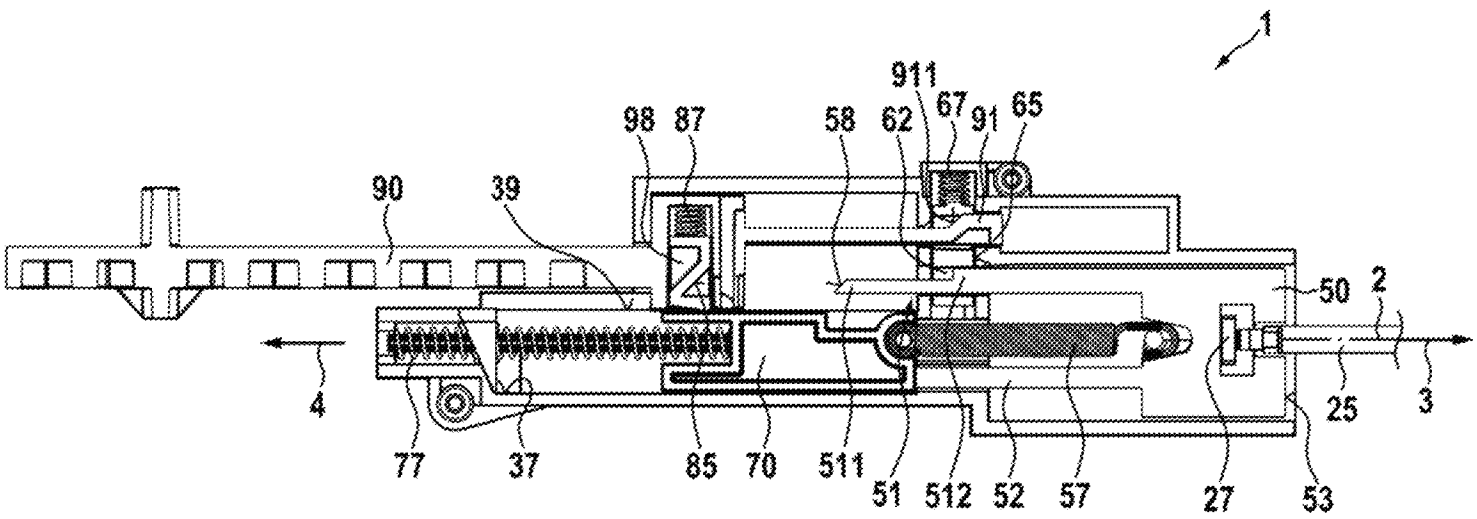
FIG. 7 shows the actuation mechanism in a seventh state of operation.
Figure 8:
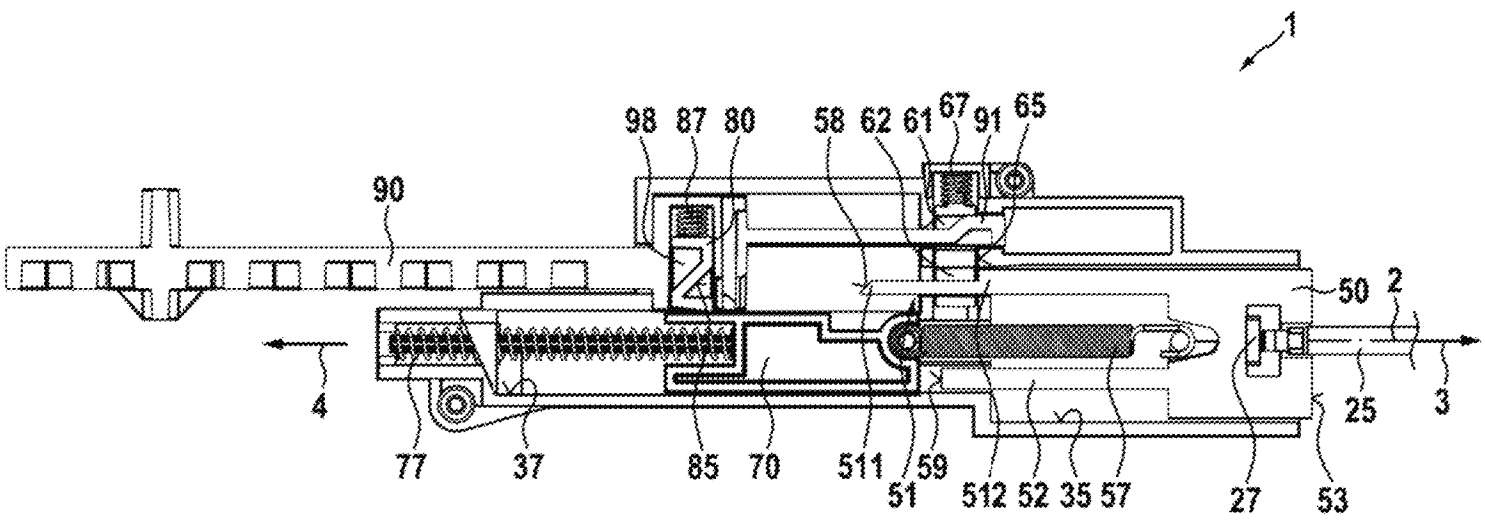
FIG. 8 shows the actuation mechanism in a eighth state of operation.

Stages of the movement of the slider and of the coupling member back into their respective initial positions are shown in FIG. 4 to FIG. 8. Comparing FIG. 4 with FIG. 5, it can be seen that the coupling member 50 in its second position does not abut the slider, thereby ensuring that the locking member 80 may be reliably moved into the non-locking position as shown in FIG. 4. Thereby, the slider 70 is decoupled from the trigger 90 and driven by the preloaded second elastic member 77 towards the abutment surface 59 of the coupling member. As can be seen in FIG. 6 the slider entrains the coupling member towards the first position when being moved towards the third position. Hence, once the trigger 90 has been shifted into the actuated position, the coupling member 50 moves from the first position into the second position and back into the first position independently from the user's interaction with the trigger 90. The opening time and the time required to close the valve is hence fully determined by the actuation mechanism, thereby reproducibly enabling very short valve opening times, which provide the impression of releasing water bullets through the valve of a correspondingly equipped toy water gun or of any other device which requires an exact timing of opening and/or closing of the valve.

Figure 9:
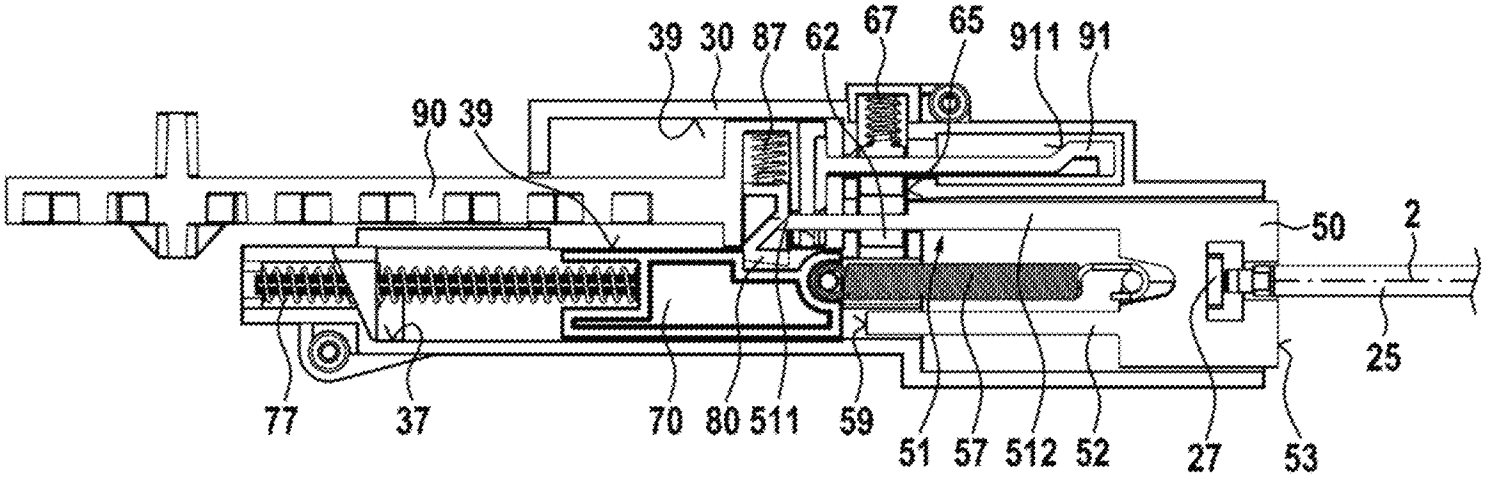
FIG. 9 shows the actuation mechanism returning back to the initial state.

To configure the actuation mechanism 1 for the next cycle, the user simply has to push the trigger back into the non-actuated position. Alternatively or in addition, the trigger may be preloaded into the non-actuated position. In this case the user simply releases the trigger. This may as well be cared for by an optional further elastic member. This movement back to the non-actuated position is shown in FIG. 9: The pusher dog 91 releases the blocking member 60 and it may be moved into the blocking position by the elastic member 67. Similarly, the locking member 80 is moved into the locking position, i.e. the locking member engages into the recess 78 of the slider 70. Now the cycle may be restarted by a user moving the trigger into the actuated position.

Figure 10:
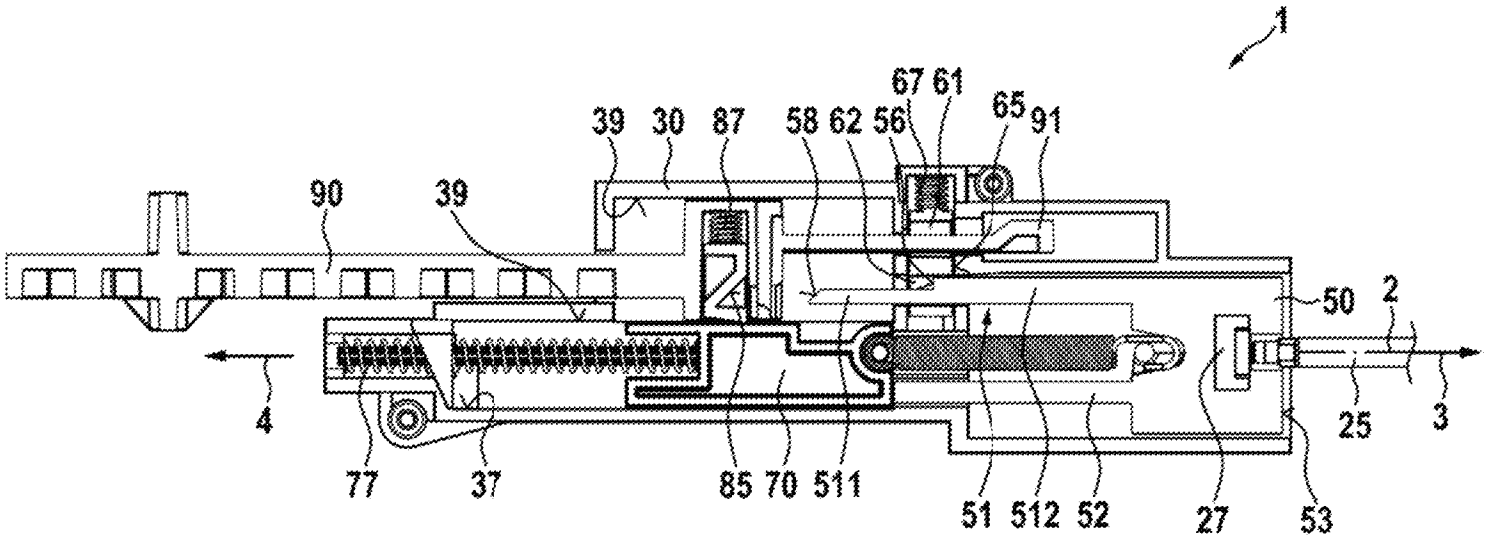
FIG. 10 shows a potential non-precise return to the initial state.
Figure 11:
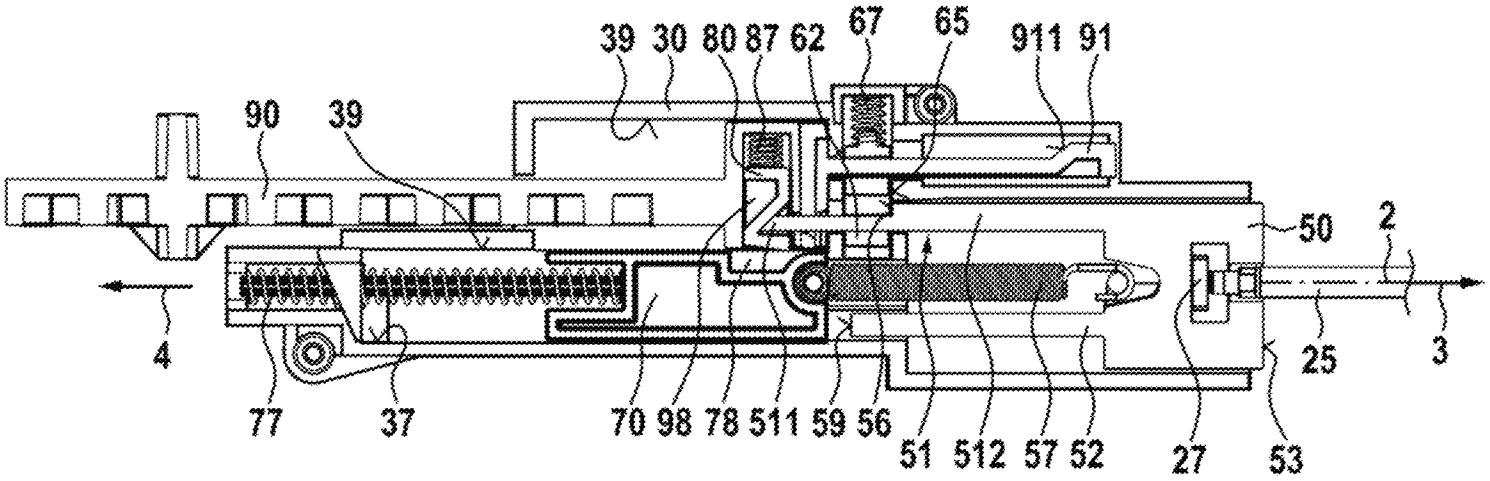
FIG. 11 shows the potential non-precise return to the initial state corrected.

FIG. 10 shows a case, in which by chance the coupling member 50 did not fully return into the first position. The blocking member 60 thus cannot reengage, i.e. a movement of the blocking member 60 back into the blocking position is blocked by the second section 512 of the first protrusion 51. In this unlikely event, shifting the trigger 90 back into the initial non-actuated position causes portion 58 of the protrusion configured to abut the locking member 80 to be abutted by the locking member 80, maintaining or moving the locking member 80 in the non-locking position, but as well moving the coupling member 50 into the first position as shown in FIG. 11. The blocking member 60 may subsequently be moved by the elastic member 67 back into the blocking position. Releasing the trigger 90 may cause the trigger to slightly shift away from the coupling member 50 due to force exerted by the elastic member 87 onto the locking member 80 and the trigger 90 as well as the locking member 80 each return into their initial position, i.e. into the non-actuated position and into the locking position, respectively, as depicted in FIG. 1.

Figure 12:
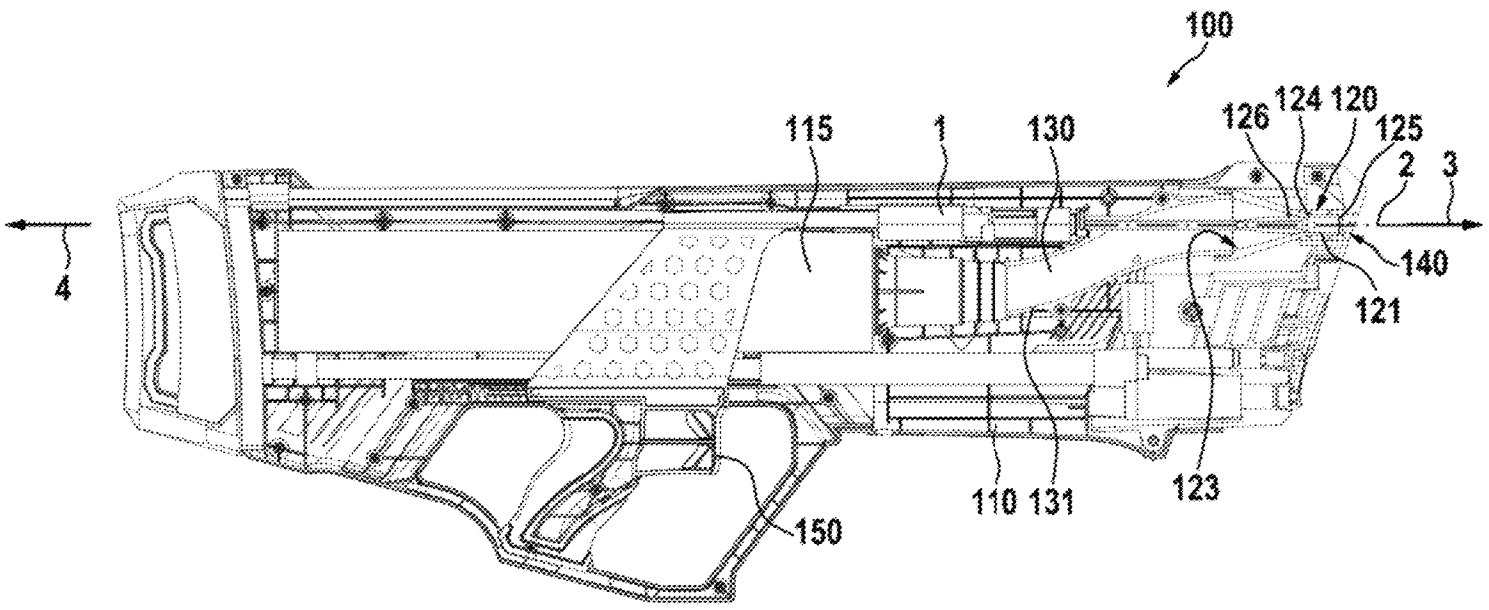
FIG. 12 shows the actuation mechanism of FIGS. 1 to 11 installed in a toy water gun, being an example for a liquid dispensing apparatus.

FIG. 12 shows a toy water gun 100 being a liquid dispensing and dosing device 100 with the actuation mechanism of FIGS. 1 to 11. A pressure tank 115 may be in fluid communication via a tube 130, being defined by a tube wall 131, with an inlet port 123 of a valve 120 or more precisely with a valve inlet port 123 of a valve conduit 121. The valve conduit 121 further has a valve outlet port 125 being in fluid communication with a nozzle 140. The coupling member 50 is coupled to a valve rod 25 of a valve member 126, being in this example a valve plunger. But ball valves may be used as well. Pulling a trigger device 150 shifts the trigger 90, being force transmittingly connected to the trigger device 150, from the non-actuated position into the actuated position and thereby initiates opening of the valve 120. Once the trigger device has been moved back into its initial depicted non-actuated position the cycle may be repeated.

LIST OF REFERENCE NUMERALS

1 actuation mechanism
2 longitudinal axis
25 rod/valve rod
27 axial fastening means
30 base
35 plain bearing surfaces
37 plain bearing surfaces
39 plain bearing surfaces
50 coupling member
51 first protrusion
52 second protrusion
53 front side of the coupling member 50
511 first section of first protrusion
512 second section of first protrusion
56 abutment of coupling member 50
57 first elastic member/spring
58 portion of coupling member configured to abut abutment 85 of locking member 80
59 abutment surface
60 blocking member
61 first recess
62 second recess
65 abutment of blocking member 60
67 elastic member/spring
70 slider
77 second elastic member
78 recess
80 locking member
85 abutment
87 elastic member/spring
90 trigger
91 pusher dog
911 inclined surface
98 recess housing locking member 80
100 toy water gun/liquid dispensing or dosing device
110 housing of device 100
115 liquid tank
120 valve
121 valve conduit
123 valve inlet port
124 valve opening/valve seat
125 valve outlet port
126 valve member
130 tube
131 tube wall
140 nozzle
150 trigger device

The invention claimed is:

1. A toy water gun actuation mechanism for controlling opening of a valve with a valve member wherein the valve member has a closed position and an open position, the water gun actuation mechanism comprising:

a base, a trigger, being movably supported relative to the base and having at least an actuated position and a non-actuated position, a coupling member configured to be connected to either or both of the valve member or to a valve member connection rod, wherein the coupling member is movably supported relative to the base at least from a first position to a second position;

a blocking member with an abutment movably supported relative to the base and relative to the coupling member, the blocking member having a blocking position and a non-blocking position, when the blocking member is in the blocking position and when the coupling member is in the first position, the abutment being positioned in a trajectory of the coupling member defined by a movement of the coupling member from the first position into the second position, when the blocking member is in a non-blocking position, the abutment is located outside the trajectory being defined by the movement of the coupling member a first elastic member is connected to the trigger and to the coupling member, the potential energy being stored by the first elastic member being increased, when the trigger is moved from the non-actuated position towards the actuated position while the coupling member is maintained in the first position by the blocking member, the trigger having a pusher dog configured to move and/or release a movement of the blocking member from the blocking position into the non-blocking position when the trigger is moved from the non-actuated position towards the actuated position.

2. The toy water gun actuation mechanism of claim 1, further comprising: a slider, the slider being:

movably supported relative to the base and having a third position and a fourth position, releasably coupled to the trigger, configured to connect the trigger with the first elastic member when coupled to the trigger, and configured to disconnect the trigger from the first elastic member when not coupled to the trigger.

3. The toy water gun actuation mechanism of claim 1, further comprising:

the trigger, the slider, or both being configured to movably support a locking member having a locking position and a non-locking position, the locking member, when in the locking position, being configured to provide a positive locking and/or an interference fit between the trigger and the slider, thereby coupling the slider to the trigger, the locking member, when in the non-locking position, being configured to release the positive locking and/or the interference fit, respectively, thereby uncoupling the trigger and the slider.

4. The toy water gun actuation mechanism of claim 3, further comprising:

the locking member, when in the locking position, being in the trajectory of the coupling member when moving the coupling member from the first position to the second position, the coupling member being configured to entrain the locking member into the non-locking position when moving the coupling member from an intermediate position to the second position.

5. The toy water gun actuation mechanism of claim 3, further comprising:

the locking member configured to be biased towards the locking position.

6. The toy water gun actuation mechanism of claim 4, further comprising:

the locking member configured to be biased towards the locking position.

7. The toy water gun actuation mechanism of claim 2, further comprising:

the trigger, the slider, or both, being configured to movably support a locking member having a locking position and a non-locking position, the locking member, when in the locking position, being configured to provide a positive locking and/or an interference fit between the trigger and the slider, thereby coupling the slider to the trigger, the locking member, when in the non-locking position, being configured to release the positive locking and/or the interference fit, respectively, thereby uncoupling the trigger and the slider.

8. The toy water gun actuation mechanism of claim 3, further comprising:

the locking member, when in the locking position, being in the trajectory of the coupling member when moving the coupling member from the first position to the second position, the coupling member being configured to entrain the locking member into the non-locking position when moving the coupling member from an intermediate position to the second position.

9. The toy water gun actuation mechanism of claim 7, further comprising:

the locking member, when in the locking position, being in the trajectory of the coupling member when moving the coupling member from the first position to the second position, the coupling member being configured to entrain the locking member into the non-locking position when moving the coupling member from an intermediate position to the second position.

10. The toy water gun actuation mechanism of claim 2, wherein the slider, when in the fourth position, is configured to be biased towards the third position.

11. The toy water gun actuation mechanism of claim 7, wherein the slider, when in the fourth position, is configured to be biased towards the third position.

12. The toy water gun actuation mechanism of claim 2, further comprising one or both of:

at least a portion of the coupling member being in the trajectory of the slider, when moving the slider from the fourth position to the third position and when the coupling member has not been shifted back into its first position; and at least a portion of the slider being in the trajectory of the coupling member, when moving the coupling member from the second position to the first position and when the slider has not been shifted back into the third position.

13. The toy water gun actuation mechanism of claim 3, further comprising one or both of:

at least a portion of the coupling member being in the trajectory of the slider, when moving the slider from the fourth position to the third position and when the coupling member has not been shifted back into its first position; and at least a portion of the slider being in the trajectory of the coupling member, when moving the coupling member from the second position to the first position and when the slider has not been shifted back into the third position.

14. The toy water gun actuation mechanism of claim 13, further comprising:

when the blocking member is in the non-blocking position and if the coupling member is in the first position, then at least a portion of the blocking member is in the trajectory or the trigger when moving the trigger towards the non-actuated position, and in that the trigger is configured to entrain the blocking member into the blocking-position when moving the trigger into the non-actuated position, while the coupling member is in the first position.

15. The toy water gun actuation mechanism of claim 1, further comprising:

when the blocking member is in the non-blocking position and if the coupling member is in the first position, then at least a portion of the blocking member is in the trajectory or the trigger when moving the trigger towards the non-actuated position, and in that the trigger is configured to entrain the blocking member into the blocking-position when moving the trigger into the non-actuated position, while the coupling member is in the first position.

16. The toy water gun actuation mechanism of claim 2, further comprising:

when the blocking member is in the non-blocking position and if the coupling member is in the first position, then at least a portion of the blocking member is in the trajectory or the trigger when moving the trigger towards the non-actuated position, and in that the trigger is configured to entrain the blocking member into the blocking-position when moving the trigger into the non-actuated position, while the coupling member is in the first position.

17. A liquid dispensing or dosing device, comprising:

a housing, and/or a liquid tank having an outlet; and/or a valve with a valve conduit, a valve inlet port, a valve opening, a valve outlet port and a movably supported valve member, wherein the valve member has closed position in which the valve member closes the valve opening and an open position in which the valve member releases the valve opening;

a tube with a tube wall providing a fluid communication of the outlet of the liquid tank with the inlet port of the valve conduit; and/or a nozzle being in fluid communication and/or integral with the outlet port of the valve; and/or the device comprising the toy water gun actuation mechanism of claim 1, wherein the valve member is attached to the coupling member and configured to entrain the valve member from the closed position into the open position if the coupling member is moved from the first position into the second position.

18. The device of claim 17, the device further comprising:

a rod having a proximal end and a distal end, wherein the distal end is attached to and/or unitary with the valve member and the distal end is attached to and/or unitary with the coupling member.

19. The liquid gun of claim 17, further comprising:

the liquid tank being a pressure tank configured to contain a pressurized liquid;

the base being integrated into a liquid gun housing;

the base being unitary with the liquid gun housing; or any combination thereof.

20. The liquid gun of claim 18 further comprising:

the liquid tank being a pressure tank configured to contain a pressurized liquid;

the base being integrated into a liquid gun housing;

the base being unitary with the liquid gun housing; or any combination thereof.

* * * * *